US011136152B2

(12) United States Patent
Fortini et al.

(10) Patent No.: US 11,136,152 B2
(45) Date of Patent: Oct. 5, 2021

(54) PACKER MACHINE AND WRAPPING METHOD TO MANUFACTURE A PACKET OF TOBACCO ARTICLES CONTAINING TWO DISTINCT GROUPS OF TOBACCO ARTICLES

(71) Applicant: G.D SOCIETA' PER AZIONI, Bologna (IT)

(72) Inventors: Massimo Fortini, Granarolo Emilia (IT); Franco Falcinelli, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 160 days.

(21) Appl. No.: 15/765,589

(22) PCT Filed: Oct. 14, 2016

(86) PCT No.: PCT/IB2016/056162

§ 371 (c)(1),
(2) Date: Apr. 3, 2018

(87) PCT Pub. No.: WO2017/064659

PCT Pub. Date: Apr. 20, 2017

(65) Prior Publication Data

US 2018/0305050 A1 Oct. 25, 2018

(30) Foreign Application Priority Data

Oct. 16, 2015 (IT) ..... 102015000062561

(51) Int. Cl.
*B65B 19/22* (2006.01)
*B65B 61/20* (2006.01)

(52) U.S. Cl.
CPC ..... *B65B 19/225* (2013.01); *B65B 61/20* (2013.01)

(58) Field of Classification Search
CPC ..... B65B 19/04; B65B 19/16; B65B 19/225; B65B 19/10; B65B 19/00; B65B 19/08;
(Continued)

(56) References Cited

U.S. PATENT DOCUMENTS 4,258,528 A 3/1981 Focke
4,506,779 A * 3/1985 Seragnoli ..... B65G 47/848 198/459.1

(Continued)

FOREIGN PATENT DOCUMENTS

DE 3739551 A1 6/1989
DE 3941844 A1 6/1991

(Continued)

OTHER PUBLICATIONS

International Application No. PCT/IB2016/056162, International Search Report and Written Opinion, dated Jan. 5, 2017.

(Continued)

*Primary Examiner* — Thanh K Truong
*Assistant Examiner* — Scott A Howell
(74) *Attorney, Agent, or Firm* — Marshall, Gerstein & Borun LLP

(57) ABSTRACT

Packer machine and wrapping method to manufacture a packet of tobacco articles containing two distinct groups of tobacco articles; the following are provided: a coupling wheel which rotates with continuous motion around a rotation axis and supports a pair of coupling pockets; a feeding station in which a first group of tobacco articles is fed to a first coupling pocket and, subsequently, a second group of tobacco articles is fed to a second coupling pocket; an actuating device which brings, downstream of the feeding station, the two coupling pockets closer to each other, until the two coupling pockets are side by side; and a releasing station, in which the two groups of tobacco articles are (Continued)

extracted together from both the coupling pockets arranged side by side, so that the two groups of tobacco articles are side by side when they come out of the coupling pockets.

23 Claims, 11 Drawing Sheets

(58) Field of Classification Search
CPC ..... B65B 19/105; B65B 19/18; B65B 19/20; B65B 19/223; B65B 61/20
USPC ..... 53/444, 158, 156, 149, 234, 466, 157, 53/154, 148, 445
See application file for complete search history.

(56) References Cited

U.S. PATENT DOCUMENTS

| | | | | |
|---|---|---|---|---|
| 4,936,440 | A | 6/1990 | Focke et al. | |
| 5,113,638 | A | 5/1992 | Focke et al. | |
| 5,357,734 | A * | 10/1994 | Focke | B65B 19/223 53/234 |
| 5,544,467 | A | 8/1996 | Focke | |
| 5,680,745 | A * | 10/1997 | Brizzi | B65B 19/02 131/283 |
| 6,286,291 | B1 * | 9/2001 | Tale' | B65B 11/32 53/234 |
| 6,439,239 | B1 * | 8/2002 | Spatafora | B65B 19/226 131/58 |
| 6,698,158 | B2 * | 3/2004 | Spatafora | B65B 19/10 53/151 |
| 6,708,466 | B2 * | 3/2004 | Spatafora | B65B 11/32 53/173 |
| 6,722,494 | B2 * | 4/2004 | Nakakado | A61F 13/15764 198/377.01 |
| 7,328,553 | B2 * | 2/2008 | Spatafora | B65B 11/32 53/210 |
| 8,647,459 | B2 * | 2/2014 | Spatafora | B65B 61/202 156/184 |
| 9,693,909 | B2 * | 7/2017 | Tombuelt-Meyer | A61F 13/15764 |
| 2001/0047639 | A1 | 12/2001 | Tale' et al. | |
| 2002/0189208 | A1 | 12/2002 | Spatafora | |
| 2006/0064944 | A1 | 3/2006 | Spatafora | |
| 2007/0266676 | A1 * | 11/2007 | Biondi | B65B 11/28 53/234 |
| 2010/0192524 | A1 * | 8/2010 | Rapparini | B65B 31/024 53/512 |

FOREIGN PATENT DOCUMENTS

| | | | |
|---|---|---|---|
| DE | 4300149 | A1 | 7/1994 |
| DE | 10210762 | A1 | 10/2003 |
| DE | 102010018238 | A1 | 10/2011 |
| EP | 0435087 | A1 | 7/1991 |
| EP | 0706941 | A2 | 4/1996 |
| EP | 0972705 | A1 | 1/2000 |
| EP | 1588960 | A1 | 10/2005 |
| EP | 1772382 | A1 | 4/2007 |
| EP | 1780127 | A1 | 5/2007 |
| EP | 1763472 | B1 | 9/2009 |
| WO | WO-80/00246 | A1 | 2/1980 |
| WO | WO-99/014141 | A1 | 3/1999 |
| WO | WO-2013/171540 | A1 | 11/2013 |

OTHER PUBLICATIONS

European Patent No. 3362365, Opposition writ filed by Focke & Co. (Gmbh & Co. KG) against Patent Owner G.D Societa per Azioni, dated Jun. 29, 2020.

European Patent No. 3362365, Observations of Patent proprietor filed by Patent Owner G.D Societa per Azioni to the Opposition filed against the European Patent No. 3362365, Opponent Focke & Co. (GmbH & Co. KG), dated Oct. 5, 2020.

* cited by examiner

PACKER MACHINE AND WRAPPING METHOD TO MANUFACTURE A PACKET OF TOBACCO ARTICLES CONTAINING TWO DISTINCT GROUPS OF TOBACCO ARTICLES

CROSS-REFERENCE TO RELATED APPLICATIONS

This is the U.S. national phase of International Application No. PCT/IB2016/056162, filed Oct. 14, 2016, which claims the benefit of Italian Patent Application No. 102015000062561, filed Oct. 16, 2015.

TECHNICAL FIELD

The present invention relates to a packer machine and to a wrapping method to manufacture a packet of tobacco articles containing two distinct groups of tobacco articles.

The present invention finds advantageous application for manufacturing a packet of cigarettes containing two distinct groups of cigarettes, to which the following description will make explicit reference without implying any loss of generality.

PRIOR ART

Since several years now a packet of cigarettes commercially referred as "TWIN" is known and which comprises a rigid outer container, housing internally, two identical groups of cigarettes (i.e. "twin" hence the commercial title of the packet of cigarettes), which are arranged one beside the other and are wound in corresponding wrappers. The patent U.S. Pat. No. 4,258,528A1 describes part of a packer machine for manufacturing a "TWIN" packet of cigarettes; said packer machine comprises two straight wrapping lines, which are identical and arranged one beside the other to manufacture in parallel two inner wraps (each formed by group of cigarettes wrapped in a wrapper of metallized paper) which are subsequently coupled to a common blank which is folded around the two inner wraps to form the corresponding rigid outer container. Each straight wrapping line originates at a hopper, from the mouths of which, the groups of cigarettes are extracted and ending at a wrapping wheel provided with pockets for housing the blanks.

However, the packer machine described in patent U.S. Pat. No. 4,258,528A1 is designed to operate only with an intermittent motion (i.e. a motion which cyclically alternates stop steps and motion steps) and therefore obliging the machinery to undergo continuous accelerations/decelerations that do not allow a high hourly productivity to be obtained (i.e. a high number of packets of cigarettes produced per time unit) while maintaining a high production quality.

DESCRIPTION OF THE INVENTION

The object of the present invention is to provide a packer machine and a wrapping method to manufacture a packet of tobacco articles containing two distinct groups of tobacco articles, of which a packer machine and wrapping method are free from the drawbacks described above and are, at the same time, easy and inexpensive to manufacture.

According to the present invention, a packer machine and a wrapping method to manufacture a packet of tobacco articles are provided, containing two distinct groups of tobacco articles, as claimed in the attached claims.

BRIEF DESCRIPTION OF THE DRAWINGS

The present invention will now be described with reference to the accompanying drawings, which illustrate a non-limiting embodiment, wherein.

PREFERRED EMBODIMENTS OF THE INVENTION

Figure 2:
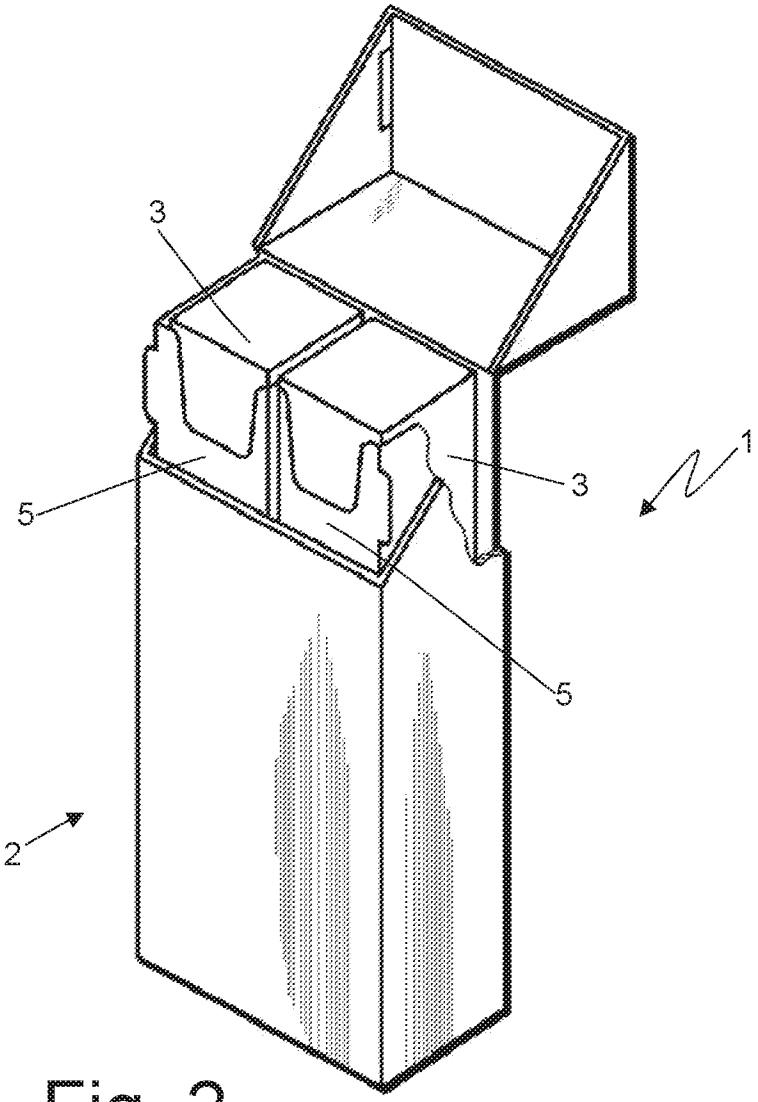
FIG. 2 is a front perspective view and in an open configuration of the "TWIN" packet of cigarettes of FIG. 1.
Figure 1:
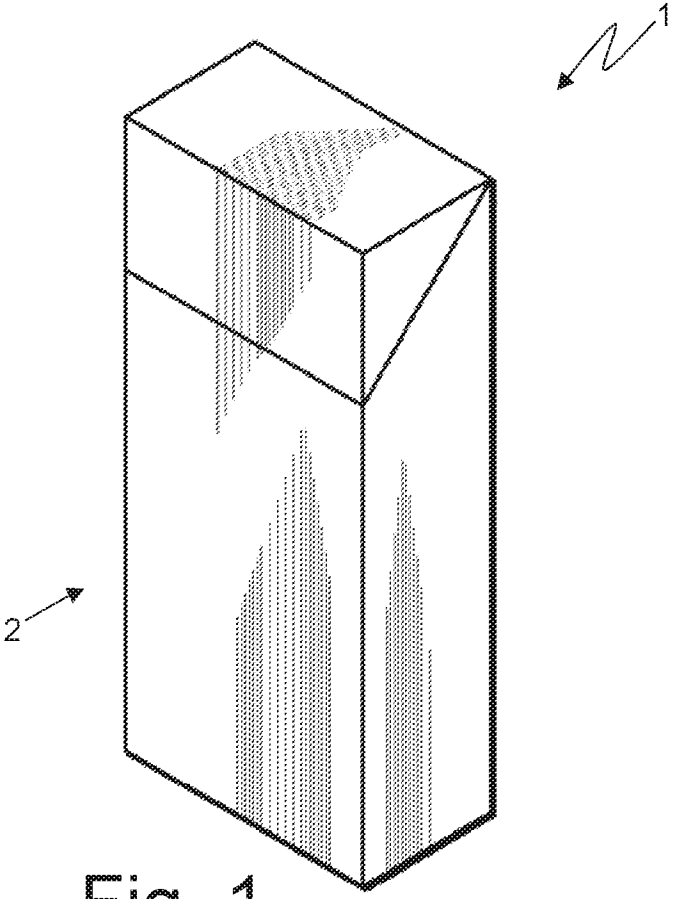
FIG. 1 is a front perspective view and in a closed configuration of a "TWIN" packet of cigarettes.
Figure 4:
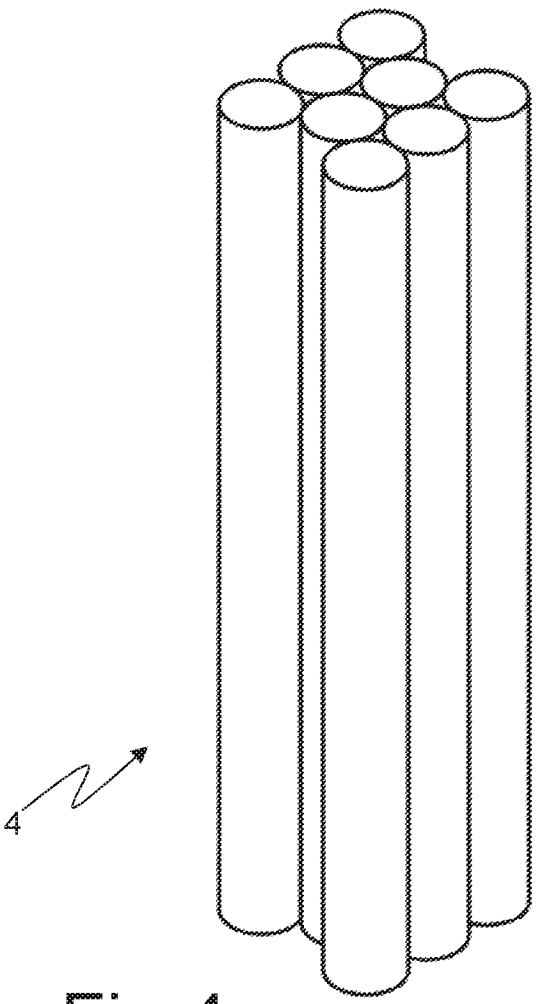
FIG. 4 is a perspective view of a group of cigarettes contained inside the inner wrap of FIG. 3.
Figure 3:
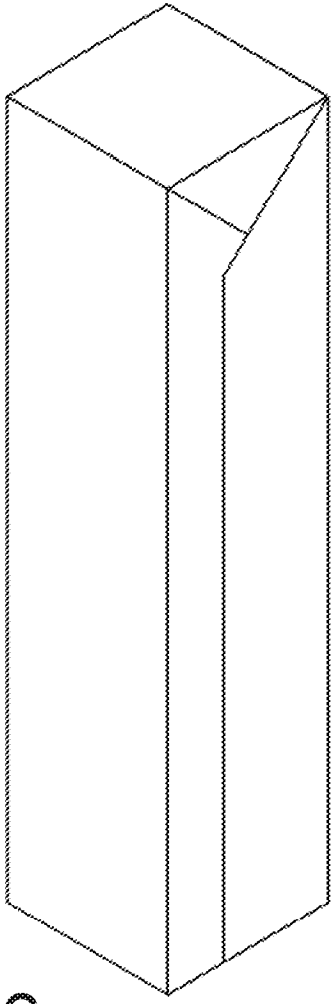
FIG. 3 is a perspective view of an inner wrap contained in the "TWIN" packet of cigarettes of FIG. 1.

In FIGS. 1 and 2, number 1 denotes as a whole a rigid packet of cigarettes comprising a rigid outer container 2 provided with a hinged lid and a pair of inner wraps 3, which are arranged side by side and are housed inside the outer container 2. Each inner wrap 3 (better illustrated in FIG. 3) encloses a group 4 of cigarettes (illustrated in FIG. 4) is parallelepiped shaped and has at the top a tear-off portion that is removed to allow access to the cigarettes. Each inner wrap 3 is manufactured in a known manner by folding a rectangular shaped wrapper around the group 4 of cigarettes. Each inner wrap 3 may be devoid of stabilization (i.e. the corresponding wrapper has no connections between the overlapping portions and therefore must always be firmly held to prevent the folds from coming apart due to elastic return), it can be stabilized by the use of glue, or it can be stabilized by heat-sealing (in the latter case, the inner wrap 3 is normally watertight sealed). According to an alternative embodiment, no inner wrappers 3 are provided and each group 4 of cigarettes is directly housed in the outer container 2 without the interposition of the corresponding inner wrap 3.

According to a preferred embodiment illustrated in FIG. 2, the rigid outer container 2 comprises two collars 5, each of which is "U"-folded to embrace a corresponding inner wrap 3 and is connected (by gluing) to the outer container 2 to partly project outwards of the open top end of the outer container 2 and engage a corresponding inner surface of the lid when the lid is arranged in the aforementioned closed position. According to an alternative embodiment not illustrated, the rigid outer container 2 comprises a single collar, which is "U"-folded so as to embrace both inner wraps 3.

Figure 5:
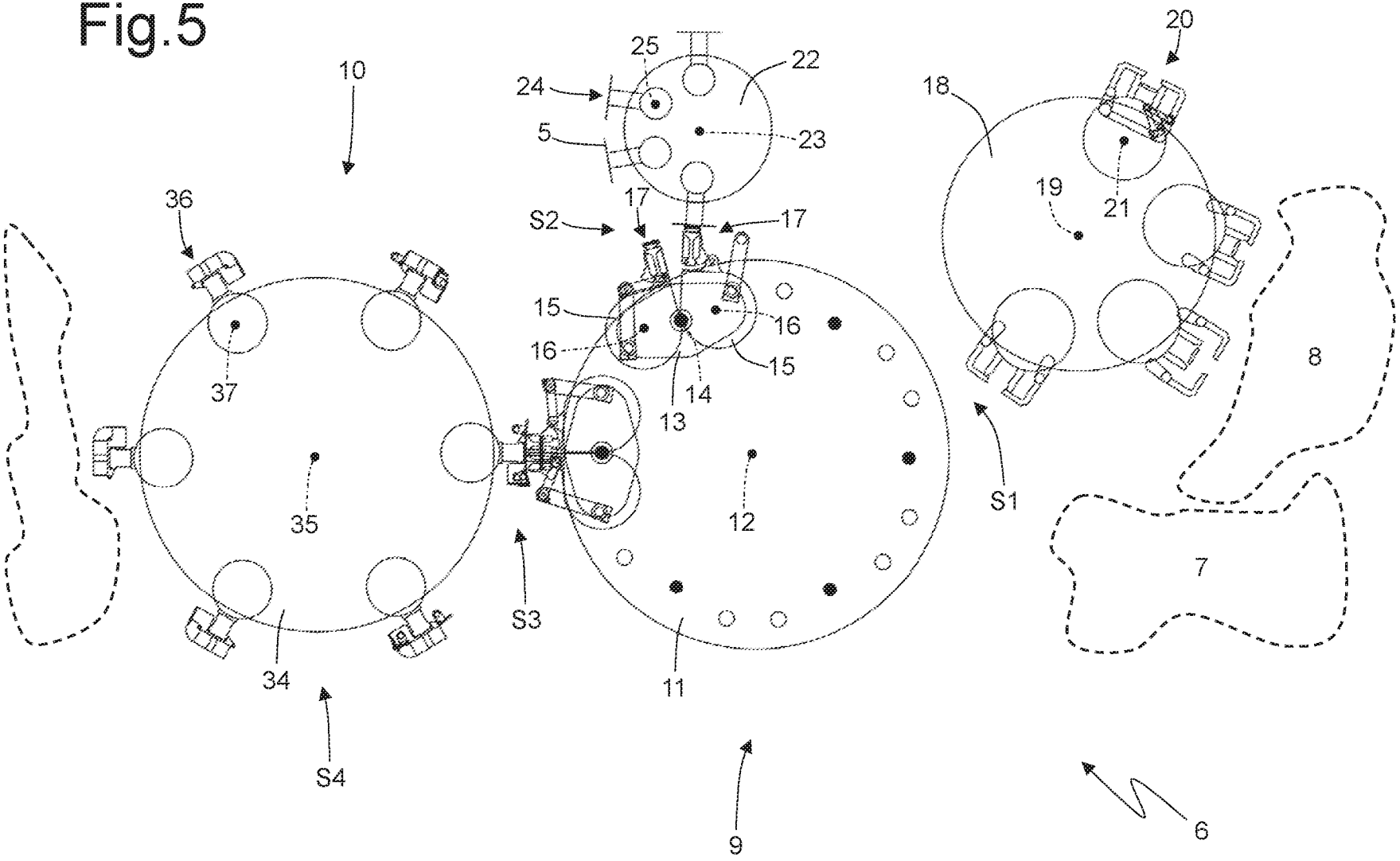
FIG. 5 is a schematic front view of part of a packer machine which produces the "TWIN" packet of cigarettes of FIG. 1 and is manufactured according to the present invention.

In FIG. 5, number 6 denotes as a whole a packer machine (only partially illustrated in FIG. 5) that is designed to manufacture the packet 1 of cigarettes described above.

The packer machine 6 comprises a forming unit 7 (known and only schematically illustrated in FIG. 5) in which the groups 4 of cigarettes are formed in succession, a wrapping unit 8 (known and only schematically illustrated in FIG. 5) in which a wrapper (known and not illustrated) is folded around each group 4 of cigarettes to form the corresponding inner wrap 3, a coupling unit 9 (wholly illustrated in FIG. 5) in which, two by two, the inner wraps 3 (i.e. the groups 4 of cigarettes contained in the inner wraps 3) are coupled to form the contents of the packets 1 of cigarettes, and a wrapping unit 10 (known and only schematically illustrated in FIG. 5) in which around each pair of inner wraps 3 (i.e. around each pair of groups 4 of cigarettes contained in the inner wraps 3) a blank (known and not illustrated) is folded to form the corresponding outer container 2.

As illustrated in FIG. 5, the coupling unit 9 of the packer machine 6 comprises a coupling wheel 11 which rotates with continuous motion (i.e. with motion having no stopping steps in which the various moving parts move with constant speed) around a central rotation axis 12 which is arranged horizontally and is perpendicular to the plane of FIG. 5. The coupling wheel 11 carries six support bodies 13 (only two of which are illustrated in FIG. 5 for simplicity), each of which is hinged to the coupling wheel 11 so as to rotate respectively to the coupling wheel 11 around a rotation axis 14 parallel to the rotation axis 12 under the control of a cam actuating device which uses the rotation of the coupling wheel 11 around the rotation axis 12.

Each support body 13 supports a pair of housing heads 15 arranged side by side; each housing head 15 is hinged to the support body 13 to rotate relative to the support body 13 around its own rotation axis 16 parallel to the rotation axis 14 under the control of the cam actuating device. Moreover, each housing head 15 supports a corresponding coupling pocket 17 which is suited to accommodate (contain) an inner wrap 3 (i.e. a group 4 of cigarettes contained in an inner wrap 3); accordingly, each support body 13 supports a pair of coupling pockets 17 arranged one near the other.

As illustrated in FIG. 5, the coupling unit 9 of the packer machine 6 comprises a feeding station S1 in which an inner wrap 3 (i.e. a group 4 of cigarettes contained in an inner wrap 3) is fed into a coupling pocket 17 of a support body 13 and, subsequently, a further inner wrap 3 (i.e. a group 4 of cigarettes contained in an inner wrap 3) is fed into the other coupling pocket 17 of the same support body 13. In other words, in the feeding station S1 the pair of coupling pockets 17 of a same support body 13 receives in succession (i.e. first one and then the other) two corresponding inner wraps 3 (i.e. two groups 4 of cigarettes contained in corresponding inner wraps 3).

As illustrated in FIG. 5, the coupling unit 9 of the packer machine 6 comprises a feeding wheel 18, which is arranged next to the coupling wheel 11 in correspondence to the feeding station S1, rotates with continuous motion around a central rotation axis 19 parallel to the rotation axis 12, and supports six feeding pockets 20 (only four of which are illustrated in FIG. 5 for simplicity) suited to receive the corresponding inner wraps 3 (i.e. the groups 4 of cigarettes contained in corresponding inner wraps 3). Each feeding pocket 20 is hinged to the feeding wheel 18 to rotate, with respect to the feeding wheel 18, around a corresponding rotation axis 21 parallel to the rotation axis 19 under the control of a cam actuating device. Each feeding pocket 20 receives an inner wrap 3 (i.e. a group 4 of cigarettes contained in an inner wrap 3) from the wrapping unit 8 and subsequently releases the inner wrap 3 (i.e. a group 4 of cigarettes contained in an inner wrap 3) to a coupling pocket 17 in the feeding station S1.

As illustrated in FIG. 5, the coupling unit 9 of the packer machine 6 comprises a feeding station S2 which is arranged upstream of the feeding station S1 relative to the rotation direction of the coupling wheel 11 and in which a collar 5 is fed to each coupling pocket 17. In particular, in the feeding station S2 a collar 5 is fed into a coupling pocket 17 of a support body 13 and, subsequently, a further a collar 5 is fed into the other coupling pocket 17 of the same support body 13. In other words, in the feeding station S2 the pair of coupling pockets 17 of a same support body 13 receives in succession (i.e. first one and then the other) two corresponding collars 5. According to a different embodiment, the feeding station S2 could feed another type of insert (for example coupons) to the coupling pockets 17 in place of the collars 5 (typically when each packet 1 of cigarettes comprises a single collar embracing both inner wraps 3); in other words, the collars 5 form a particular type of insert that can be coupled to the inner wraps 3 (i.e. to the groups 4 of cigarettes contained in corresponding inner wraps 3) in the feeding station S2, but according to other embodiments the collars 5 can be replaced by other types of inserts (for example coupons).

As illustrated in FIG. 5, the coupling unit 9 of the packer machine 6 comprises a feeding wheel 22, which is arranged next to the coupling wheel 11 in correspondence to the feeding station S2, rotates with continuous motion around a central rotation axis 23 parallel to the rotation axis 12, and supports six sucking holding heads 24 (only four of which are illustrated in FIG. 5 for simplicity) suited to hold the corresponding inserts (i.e. the collars 5) and are hinged to the feeding wheel 22 to rotate, with respect to the feeding wheel 22, around corresponding rotation axes 25 parallel to the rotation axis 23 under the control of a cam actuating device. Each sucking holding head 24 receives an insert (i.e. a collar 5) from a feeding device (not illustrated) of known type and subsequently releases the insert (i.e. the collar 5) to a coupling pocket 17 in the feeding station S2.

As illustrated in FIG. 5, the coupling unit 9 of the packer machine 6 comprises a releasing station S3, in which the two inner wraps 3 (i.e. the two groups 4 of cigarettes contained in corresponding inner wraps 3) contained in the two coupling pockets 17 of a same support body 13 are extracted together (that is, simultaneously) from both coupling pockets 17 so that the two inner wraps 3 (i.e. the two groups 4 of cigarettes contained in corresponding inner wraps 3) come out together, arranged side by side and are transferred to the wrapping unit 10.

Figure 6:
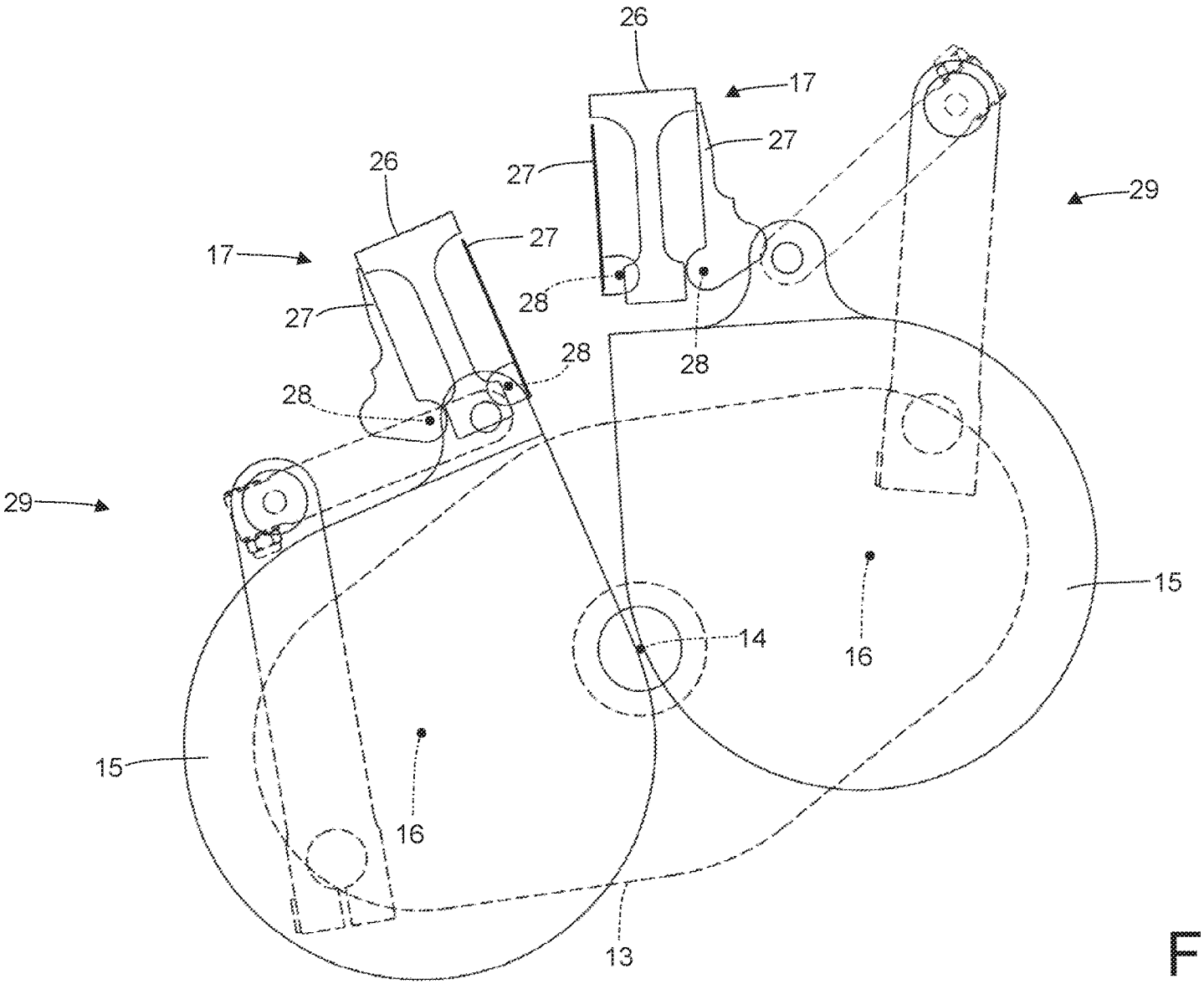
FIG. 6 is a view in enlarged scale of a pair of coupling pockets of the packer machine of FIG. 5.

As illustrated in FIG. 6, each housing head 15 is "drop"-shaped, bordered on one side by a cylindrical surface (having an amplitude of about 270°) and from the opposite side, by two flat walls, which meet each other at an edge. In one same support body 13, the two housing heads 15 are arranged mirrored one with respect to the other so that the corresponding edges between the flat walls will face each other. Moreover, in a same support body 13, a coupling pocket 17 (to the left in FIG. 6) is arranged in correspondence to the corner between the flat walls of its own housing head 15, whereas the other coupling pocket 17 (to the right in FIG. 6) is arranged relatively far apart from the edge between the flat walls of its own housing head 15 (in particular is arranged in correspondence to the transition between the cylindrical wall and a flat wall).

As illustrated in FIG. 6, each coupling pocket 17 comprises a bottom wall 26 which is mounted so as to be radially mobile on the corresponding housing head 15 to radially move under the control of the cam actuating device between an extracted position (i.e. radially outermost) and a retracted position (i.e. radially innermost). In addition, each coupling pocket 17 comprises two lateral walls 27, which are hinged so as to rotate around corresponding rotation axes 28 parallel to the rotation axis 12 to move under the control of the cam actuating device between an open position (illustrated as example in FIGS. 9 and 10) in which the two lateral walls 27 are mutually divergent (i.e. they assume a "V" shape) and a closed position (illustrated in FIG. 6) in which the two lateral walls 27 are mutually parallel.

According to a preferred, but not binding, embodiment illustrated in FIG. 6, for each coupling pocket 17 the cam actuating device comprises an articulated mechanical connection 29, which is hinged both to the corresponding support body 13, and to the corresponding housing head 15 and exploits the relative movement between the support body 13 and the housing head 15 for controlling the rotation of the lateral walls 27 of the coupling pocket 17 (i.e. to move the lateral walls 27 between the open position and the closed position); in other words, the mechanical connection 29 controls the rotation of the lateral walls 27, exploiting, in order to control, the relative movement between the support body 13 and the housing head 15. According to an alternative embodiment, the mechanical connection 29 also controls the axial sliding of the bottom wall 26 of the coupling pocket 17 (i.e. controls both the rotation of the lateral walls 27 of the coupling pocket 17, and the axial sliding of the bottom wall 26 of the coupling pocket 17). According to a further embodiment, the mechanical connection 29 only controls the axial sliding of the bottom wall 26 of the coupling pocket 17.

Figure 7:
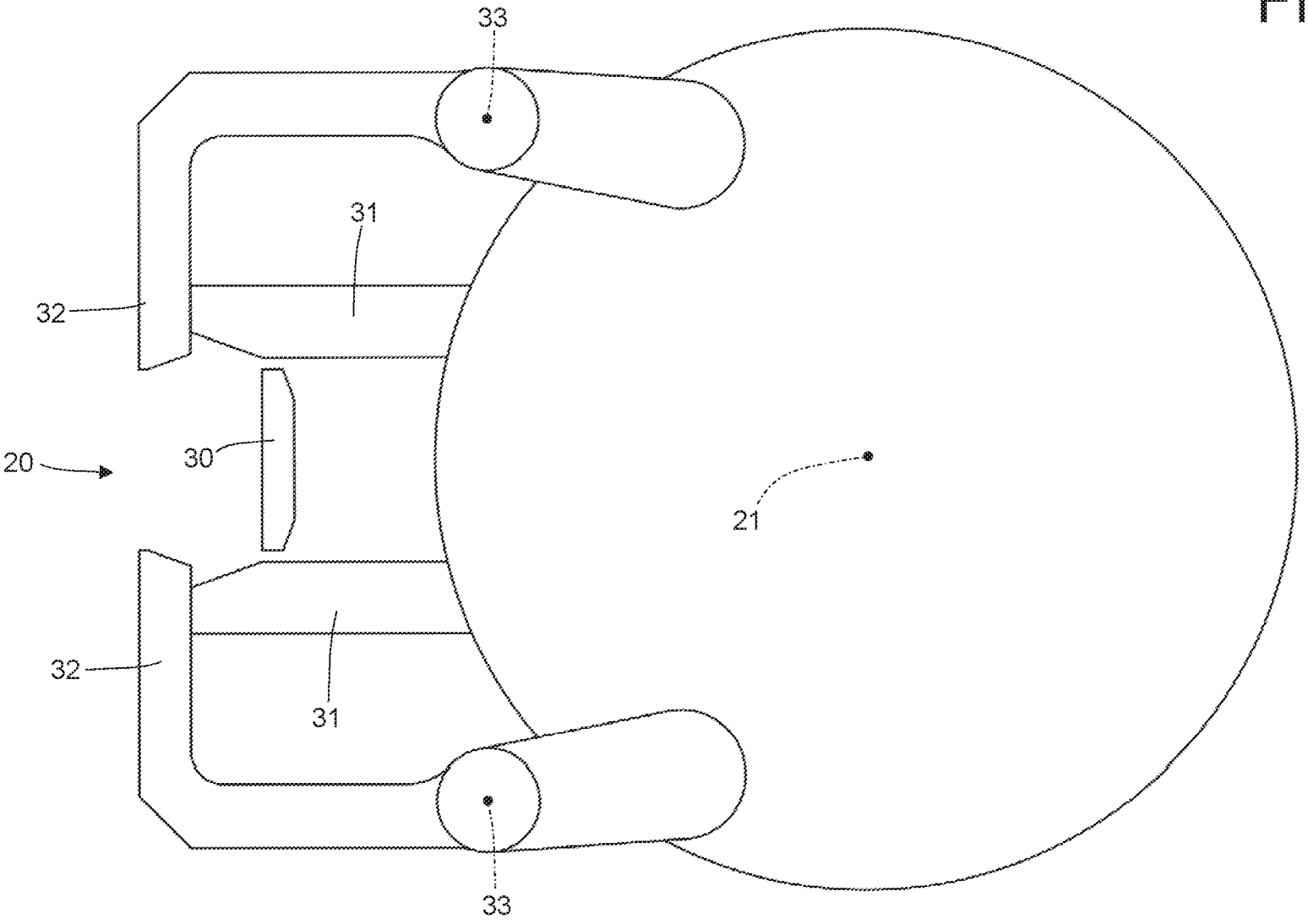
FIG. 7 is a view in enlarged scale of a feeding pocket of the packer machine of FIG. 5.

As illustrated in FIG. 7, each feeding pocket 20 comprises a bottom wall 30 which is mounted so as to be radially mobile and to radially move between an extracted position (i.e. radially outermost) and a retracted position (i.e. radially innermost). In addition, each feeding pocket 20 comprises two fixed lateral walls 31 and two holding elements 32, which are "L"-shaped, and are hinged so as to rotate around corresponding rotation axes 33 parallel to the rotation axis 19 so as to move between an operating position (illustrated in FIG. 7) in which the two holding elements 32 keep the corresponding inner wrap 3 (i.e. the group 4 of cigarettes contained in an inner wrap 3) inside the feeding pocket 20 and a rest position (not illustrated) in which the two holding elements 32 allow the corresponding inner wrap 3 (i.e. the group 4 of cigarettes contained in an inner wrap 3) to enter/exit the feeding pocket 20.

Figure 8:
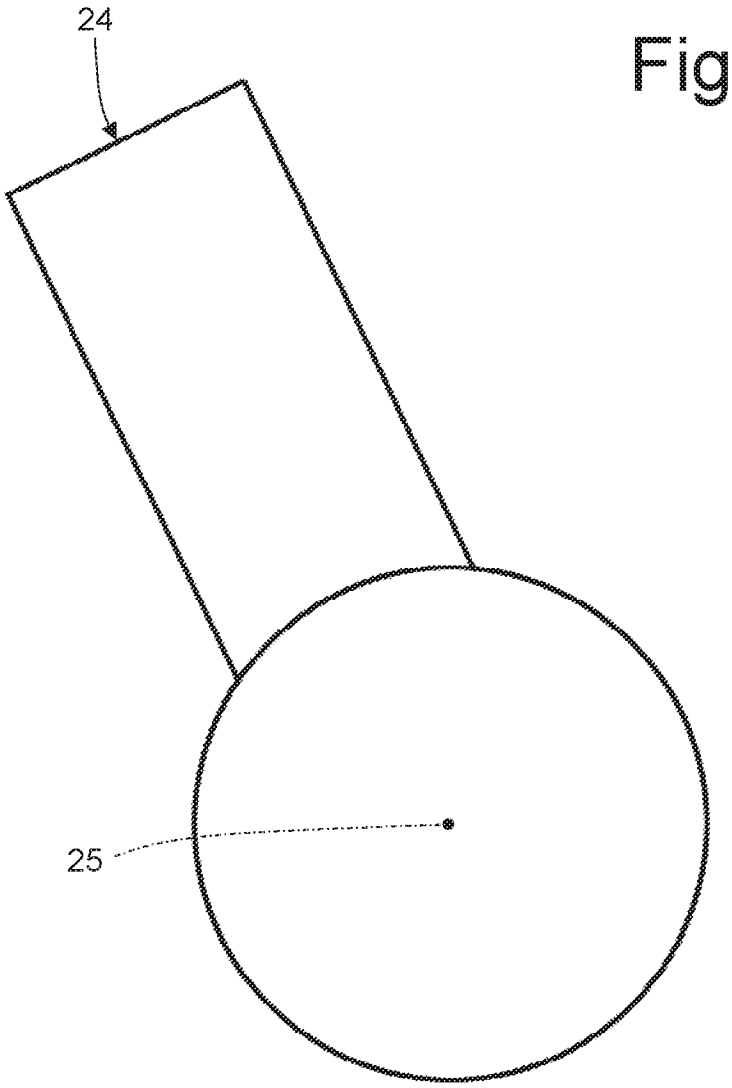
FIG. 8 is a view in enlarged scale of a holding head of the packer machine of FIG. 5.

In FIG. 8 the sucking holding head 24 of the feeding wheel 22 is illustrated in enlarged scale.

As illustrated in FIG. 5, the wrapping unit 10 comprises (among other things) a wrapping wheel 34 which rotates with continuous motion around a central rotation axis 35 parallel to the rotation axis 12. The wrapping wheel 34 supports six wrapping pockets 36, each of which is hinged to the wrapping wheel 34 so as to rotate relative to the wrapping wheel 34 around a rotation axis 37 parallel to the rotation axis 35 under the control of a cam actuating device. Each wrapping pocket 36 receives a corresponding blank at a feeding station S4 upstream from the releasing station S3 with respect to the rotation direction of the wrapping wheel 34; the blank is arranged "U"-folded inside the wrapping pocket 36. Furthermore, in the releasing station S3 and from the coupling wheel 11 each wrapping pocket 36 receives a pair of inner wraps 3 (i.e. of groups 4 of cigarettes contained in the inner wraps 3) arranged side by side and coupled to the corresponding collars 5 which are arranged inside of the "U"-folded blank; downstream of the releasing station S3, the blank is folded around the pair of inner wraps 3 (i.e. the groups 4 of cigarettes contained in the inner wraps 3) to form the outer container 2 (the folding of the blank begins in the wrapping wheel 34, and is completed downstream of the wrapping wheel 34).

With reference to what is illustrated in FIGS. 9-13, in what follows, the operation of the coupling unit 9 is described by following the coupling of two inner wraps 3 (i.e. two groups 4 of cigarettes contained in the inner wraps 3) in the two coupling pockets 17 of a same support body 13.

Figure 9:
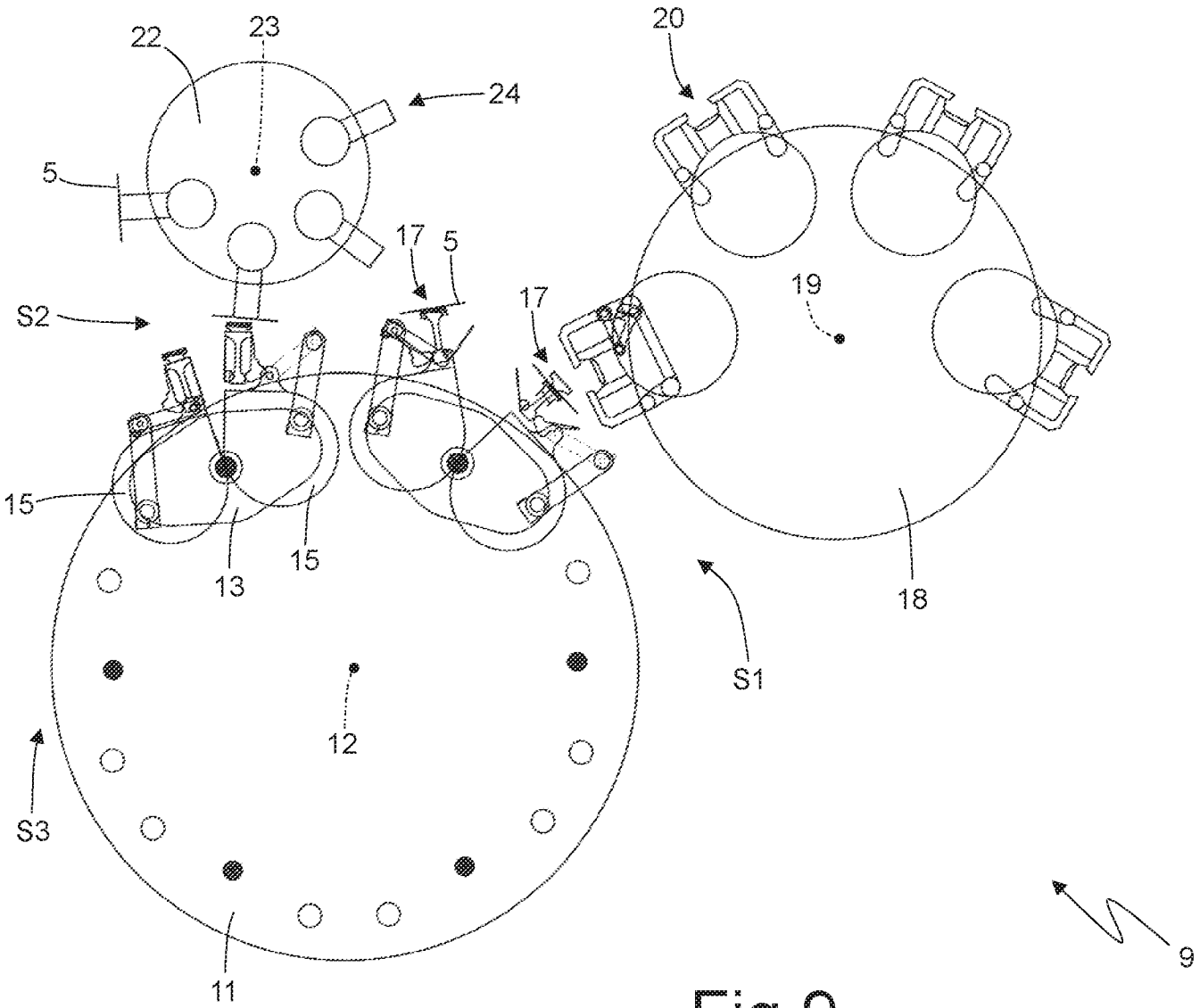
FIGS. 9-13 are five schematic and front views of a coupling wheel of the packer machine of FIG. 5 in five different operating positions.
Figure 10:
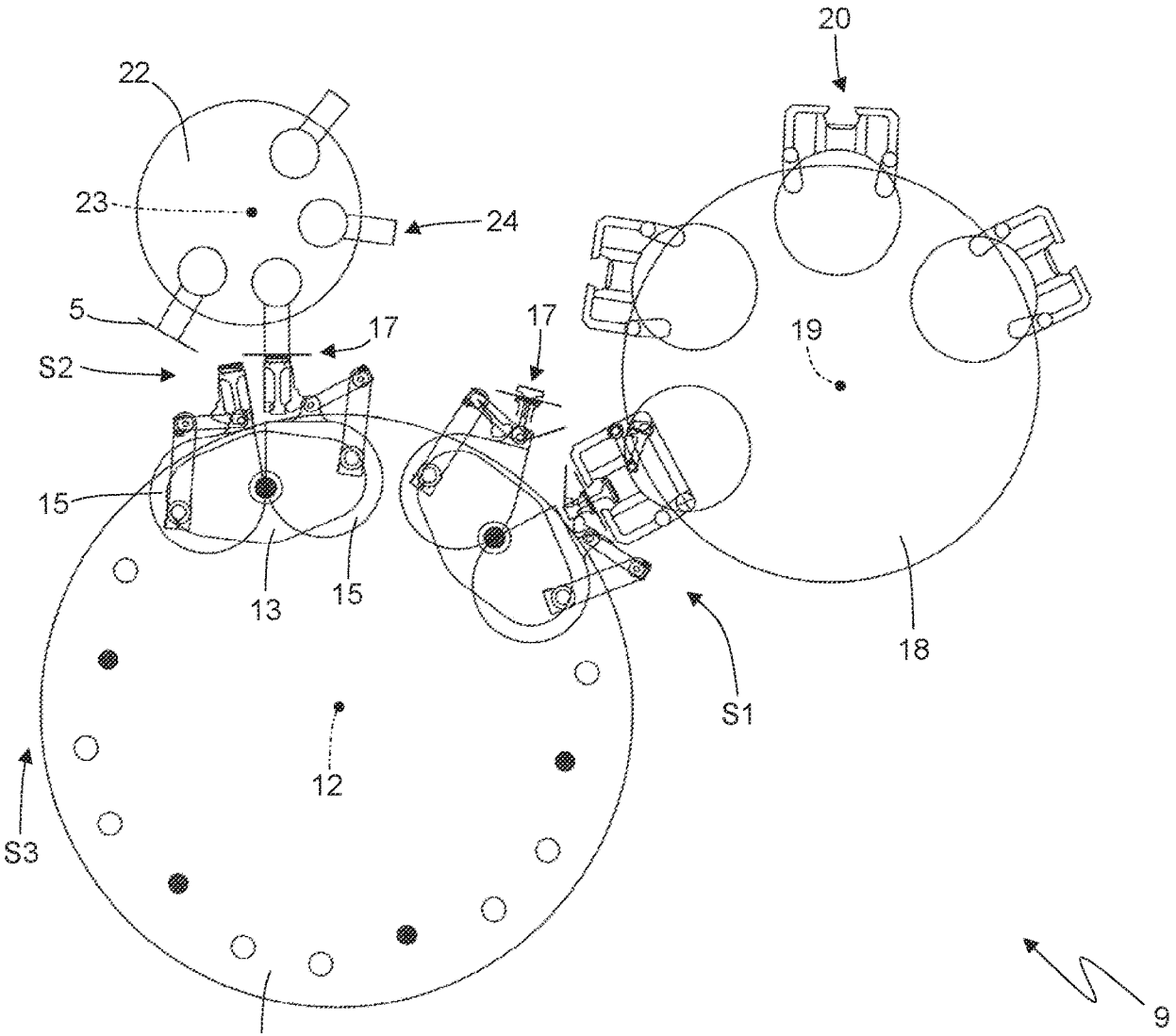
Figure 11:
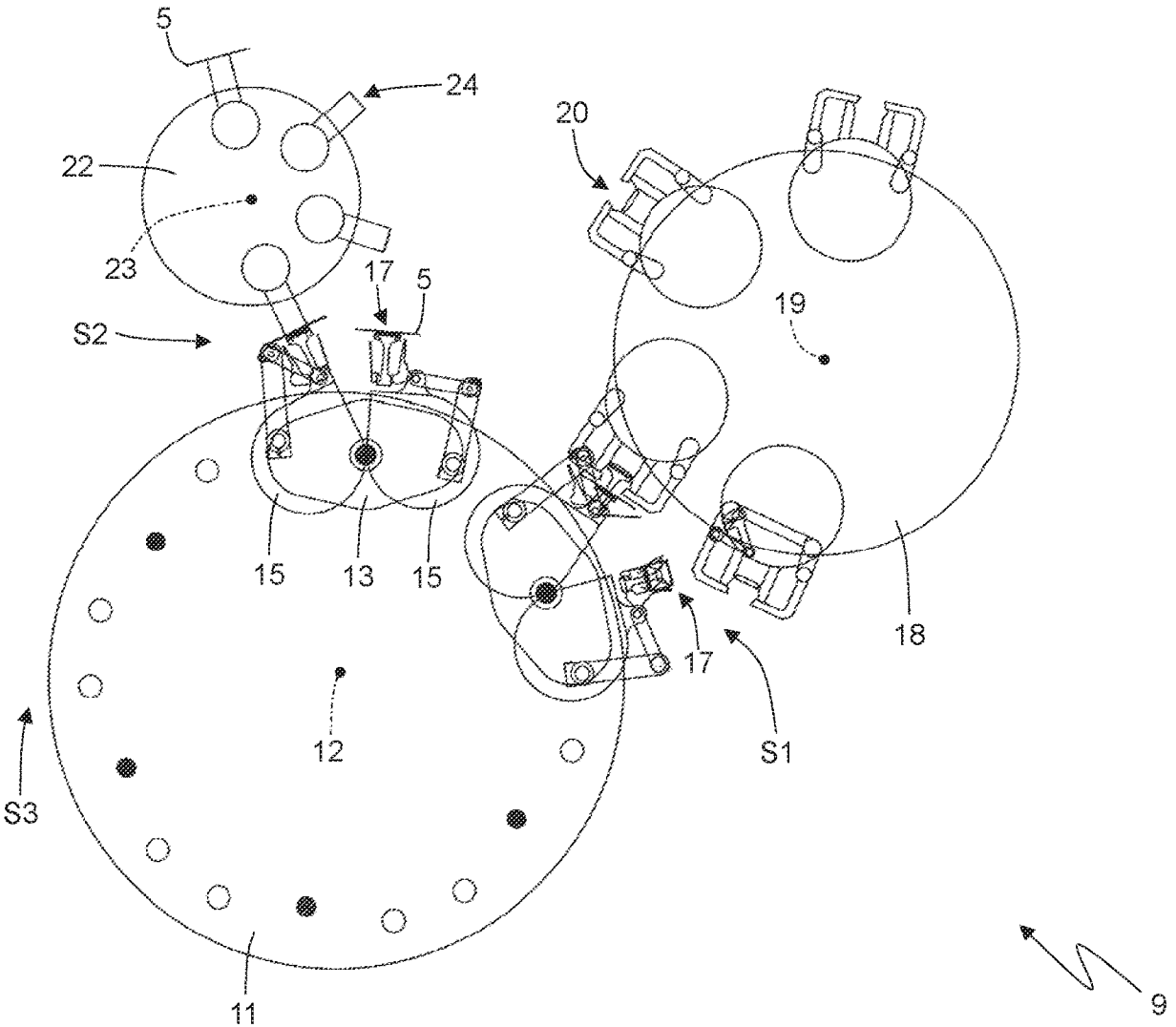
Figure 12:
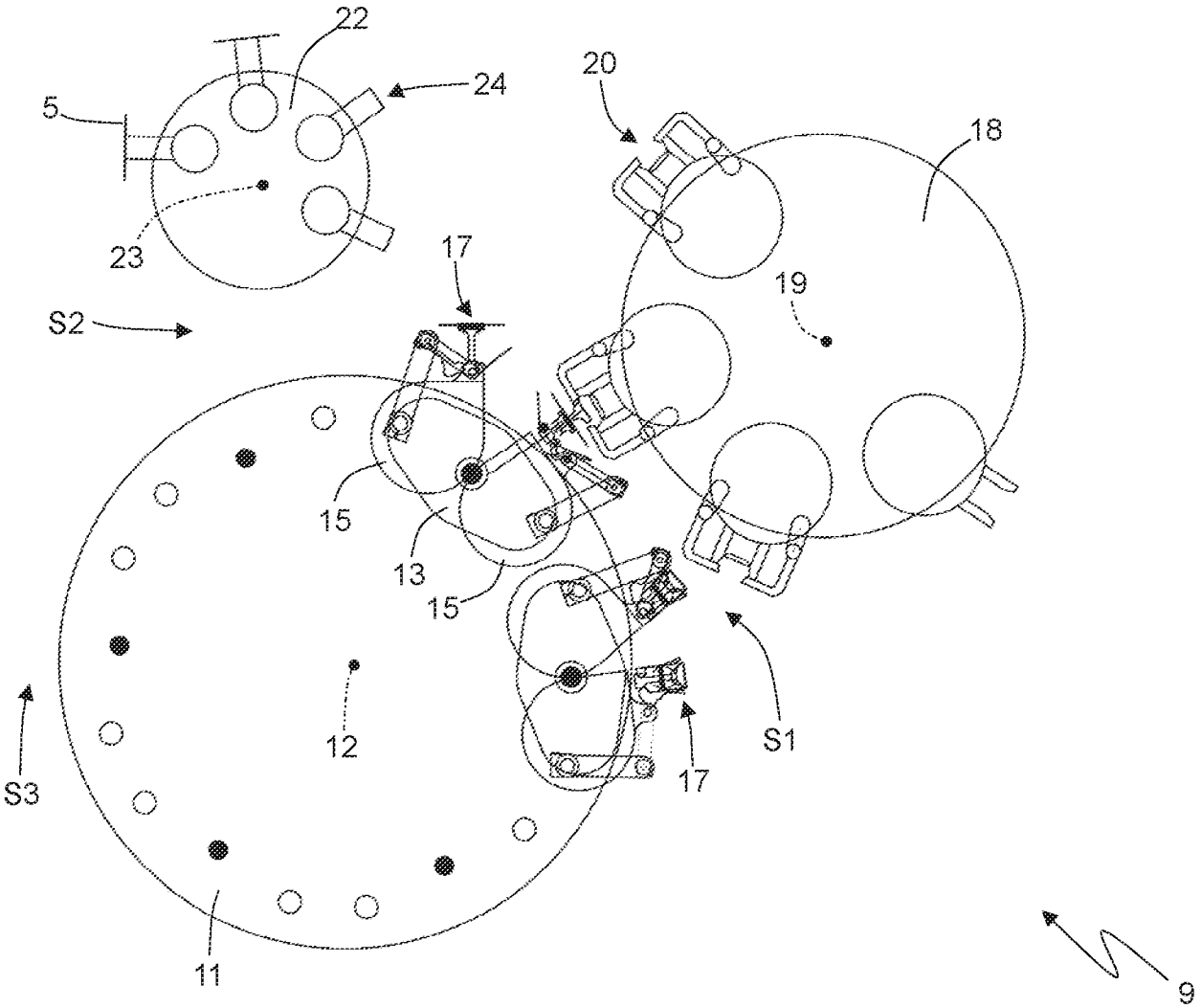

Initially, and as illustrated in FIGS. 9, 10 and 11 (support body 13 on the left), the rotation of the coupling wheel 11 around the rotation axis 12 brings the two coupling pockets 17 of a same support body 13 to pass through the feeding station S2, in which the two coupling pockets 17 receive in succession two inserts (i.e. two collars 5) from the same number of holding heads 24 of the feeding wheel 22. In the feeding station S2, the bottom wall 26 of each coupling pocket 17 is arranged and kept in the extracted position and holds the corresponding insert (i.e. the corresponding collar 15) by suction. During the transfer of an insert (i.e. of a collar 15) into the feeding station S2, the corresponding coupling pocket 17 rotates relative to the coupling wheel 11 around the rotation axis 16 (together with its own housing head 15) and the corresponding holding head 24 rotates with respect to the feeding wheel 22 around the rotation axis 25 so as to maintain the coupling pocket 17 and the holding head 24 aligned with each other for a few moments.

Subsequently and as illustrated in FIGS. 10 and 11 (support body 13 on the right), the rotation of the coupling wheel 11 around the rotation axis 12 brings the two coupling pockets 17 of a same support body 13 to pass through the feeding station S1, in which the two coupling pockets 17 receive two successive inner wraps 3 (i.e. groups 4 of cigarettes contained in the inner wraps 3) from the same number of pockets 20 of the feeding wheel 18. That is, initially (as illustrated in FIG. 10) the coupling pocket 17 arranged upstream receives an inner wrap 3 (i.e. a group 4 of cigarettes contained in an inner wrap 3) from a feeding pocket 20 and subsequently (as illustrated in FIG. 11) the coupling pocket 17 arranged downstream receives, from a successive feeding pocket 20, another inner wrap 3 (i.e. a group 4 of cigarettes contained in an inner wrap 3).

In the feeding station S1, the bottom wall 26 of each coupling pocket 17 is initially arranged in the extracted position and gradually moves towards the retracted position as the corresponding inner wrap 3 (i.e. the group 4 of cigarettes contained in an inner wrap 3) enters the coupling pocket 17; similarly, in the feeding station S1, the bottom wall 30 of each feeding pocket 20 is initially arranged in the retracted position and gradually moves towards the extracted position as the corresponding inner wrap 3 (i.e. the group 4 of cigarettes contained in an inner wrap 3) comes out of the feeding pocket 20 and enters into the coupling pocket 17. In this way, in the transfer from the feeding pocket 20 to the coupling pocket 17 the inner wrap 3 (i.e. the group 4 of cigarettes contained in an inner wrap 3) is always radially contained ("pinched") between the bottom walls 26 and 30 of the two pockets 17 and 20.

In the feeding station S1, the lateral walls 27 of each coupling pocket 17 are initially arranged in the open position and gradually move towards the closed position as the corresponding inner wrap 3 (i.e. the group 4 of cigarettes contained in an inner wrap 3) enters into the coupling pocket 17. In the feeding station S1, the two holding elements 32 of each feeding pocket 20 are arranged in the rest position to allow the corresponding inner wrap 3 (i.e. the group 4 of cigarettes contained in an inner wrap 3) to enter/exit the feeding pocket 20.

During the transfer of an inner wrap 3 (i.e. of a group 4 of cigarettes contained in an inner wrap 3) in the feeding station S1, the corresponding coupling pocket 17 rotates relative to the coupling wheel 11 around the rotation axis 16 (together with its own housing head 15) and the corresponding feeding pocket 20 rotates relative to the feeding wheel 18 around the rotation axis 21 so as to keep the coupling pocket 17 and the feeding pocket 20 aligned with each other for a few moments.

Figure 13:
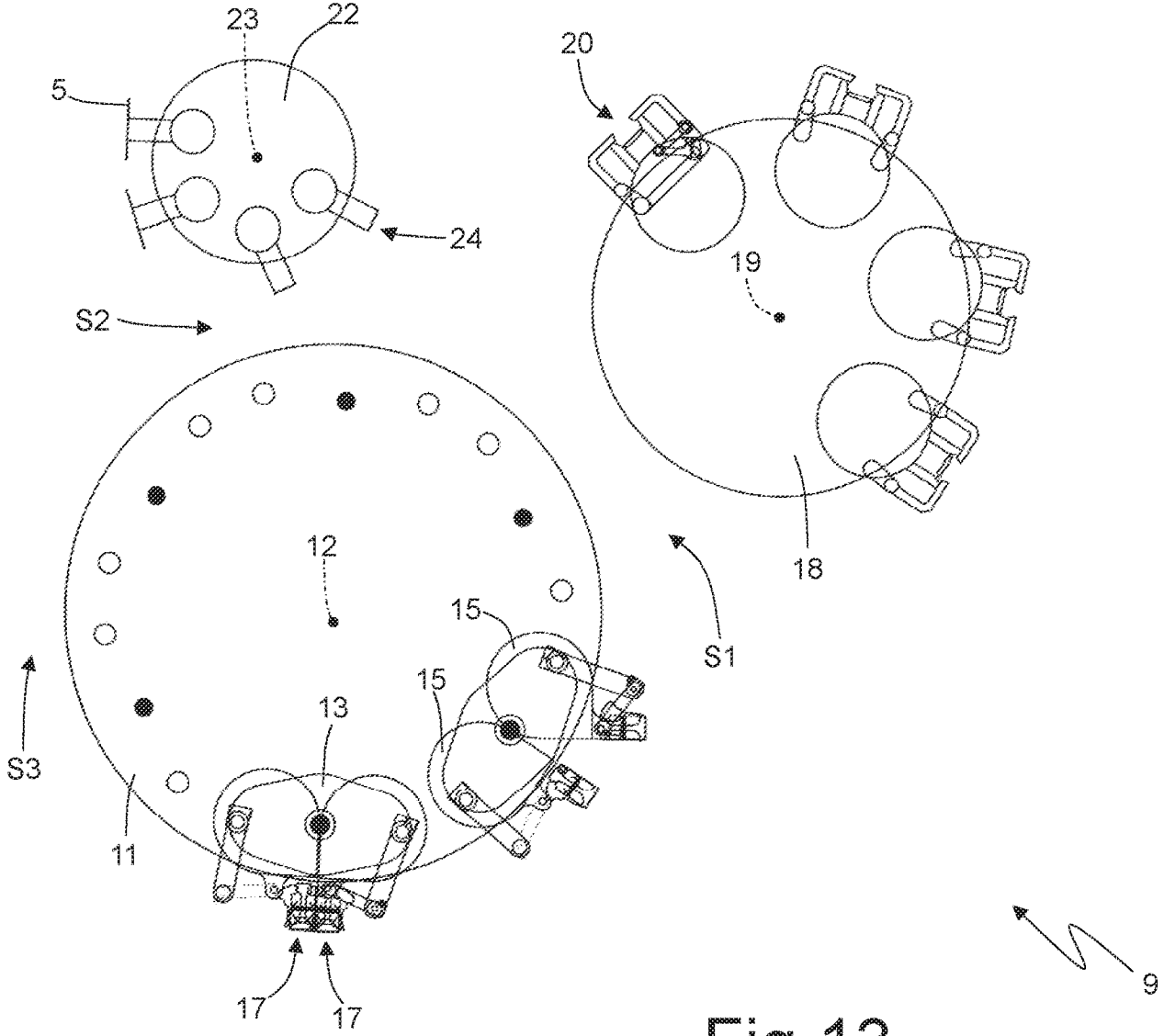

Downstream of the feeding station S1 relative to the rotation direction of the coupling wheel 11, the two coupling pockets 17 of a same support body 13 are moving relative to each other (together with the corresponding housing heads 15) under the thrust of the cam actuating device so as to approach each other in order to arrange the two coupling pockets 17 side by side (in contact one with the other) as illustrated in FIG. 13 (support body 13 on the left). In other words the two housing heads 15 of a same support body 13, downstream of the feeding station S1, are oriented so as to arrange the corresponding coupling pockets 17 side by side.

In the releasing station S3, the two inner wraps 3 (i.e. the two groups 4 of cigarettes contained in the inner wraps 3) housed in the two coupling pockets 17 of a same support body 13 and arranged side by side are extracted together (i.e. simultaneously and with synchronized movements) from the coupling pockets 17; in this way, the two inner wraps 3 (i.e. the two groups 4 of cigarettes contained in the inner wraps 3) come out together, arranged side by side, of the two coupling pockets 17 of a same support body 13 so as to enter together, arranged side by side, in a same wrapping pocket 36 of the wrapping wheel 34 and are then inserted into a "U"-folded blank previously fed to the wrapping pocket 36.

In the releasing station S3, the bottom wall 26 of each coupling pocket 17 is initially arranged in the retracted position and gradually moves towards the extracted position as the corresponding inner wrap 3 (i.e. the group 4 of cigarettes contained in an inner wrap 3) comes out of the coupling pocket 17. In the releasing station S3, the lateral walls 27 of each coupling pocket 17 are initially arranged in the closed position and gradually move towards the open position as the corresponding inner wrap 3 (i.e. the group 4 of cigarettes contained in an inner wrap 3) comes out of the coupling pocket 17.

The packer machine 6 described above has numerous advantages.

In the first place, the packer machine 6 described above can operate with continuous motion (i.e. a motion without stopping steps wherein the various moving parts move with constant speed) which substantially reduces the mechanical stress to which the inner wraps 3 (and thus the cigarettes contained in the inner wraps 3) are subjected, allowing to operate at a high hourly productivity (i.e. a high number of packets of cigarettes produced per time unit) while maintaining a high production quality.

Moreover, the packer machine 6 described above is relatively simple and compact and can be obtained by modifying an existing packer machine with the only substantial addition of the coupling units 9.

The embodiment illustrated in the accompanying figures refers to the manufacturing of a packet of cigarettes, but the present invention is also applicable, without substantial changes, to the manufacturing of any other type of packet of tobacco articles (for example, a packet of cigars, a packet of liquid vaporizing type electronic cigarettes, a packet of new generation cigarettes without tobacco combustion . . . ).

The invention claimed is:

1. A packer machine (6) to manufacture a packet (1) of tobacco articles containing two distinct groups (4) of tobacco articles; the packer machine (6) comprises:

a coupling wheel (11) which rotates with a continuous motion around a first rotation axis (12) and supports a pair of coupling pockets (17), each designed to contain a group (4) of tobacco articles;

a first feeding station (S1) in which a first group (4) of tobacco articles is fed to a first coupling pocket (17) and, subsequently, a second group (4) of tobacco articles is fed to a second coupling pocket (17);

an actuating device which brings, downstream of the first feeding station (S1), the two first and second coupling pockets (17) closer to each other, until the two first and second coupling pockets (17) are side by side; and a releasing station (S3), in which the two groups (4) of tobacco articles are extracted together from both the first and second coupling pockets (17) arranged side by side, so that the two groups (4) of tobacco articles are side by side when they come together out of the first and second coupling pockets (17), wherein:

each first or second coupling pocket (17) comprises two lateral walls (27) so that a downstream side wall (27) of the first coupling pocket (17) faces an upstream side wall (27) of the second coupling pocket (17), in the first feeding station (S1) the downstream side wall (27) of the first coupling pocket (17) is arranged at a first distance from the upstream side wall (27) of the second coupling pocket (17), and in the releasing station (S3) the downstream side wall (27) of the first coupling pocket (17) is arranged at a second distance smaller than the first distance from the upstream side wall (27) of the second coupling pocket (17) as the two first and second coupling pockets (17) are side by side.

2. A packer machine (6) according to claim 1, wherein the coupling wheel (11) comprises a support body (13), which supports the two coupling pockets (17) and is hinged to the coupling wheel (11) so as to rotate relative to the coupling wheel (11) around a second rotation axis (14) which is parallel to the first rotation axis (12).

3. A packer machine (6) according to claim 2, wherein the support body (13) comprises two housing heads (15), each of which supports a corresponding coupling pocket (17) and is hinged to the support body (13) so as to rotate relative to the support body (13) around its own third rotation axis (16) which is parallel to the second rotation axis (14).

4. A packer machine (6) according to claim 3, wherein, for each coupling pocket (17), the actuating device comprises an articulated mechanical connection (29), which is hinged both to the support body (13) and to the corresponding housing head (15) and uses the relative movement between the support body (13) and the corresponding housing head (15).

5. A packer machine (6) according to claim 4, wherein each coupling pocket (17) comprises a bottom wall (26), which is mounted so as to be radially mobile on the corresponding housing head (15) and to move between an extracted position and a retracted position.

6. A packer machine (6) according to claim 5, wherein the bottom wall (26) of each coupling pocket (17) is a sucking wall.

7. A packer machine (6) according to claim 5, wherein, in the first feeding station (S1), the bottom wall (26) of each coupling pocket (17) is initially arranged in the extracted position and gradually moves towards the retracted position as the corresponding group (4) of tobacco article enters the coupling pocket (17).

8. A packer machine (6) according to claim 1, wherein each coupling pocket (17) comprises two lateral walls (27), which are hinged so as to rotate around corresponding fourth rotation axes (28) parallel to the first rotation axis (12) and to move between an open position, in which the two lateral walls (27) diverge from one another, and a closed position, in which the two lateral walls (27) are parallel to each other.

9. A packer machine (6) according to claim 8, wherein, in the first feeding station (S1), the lateral walls (27) of each coupling pocket (17) are initially arranged in the open position and gradually move towards the closed position as the corresponding group (4) of tobacco article enters the coupling pocket (17).

10. A packer machine (6) according to claim 1 and comprising a first feeding wheel (18), which is arranged next to the coupling wheel (11) in correspondence to the first feeding station (S1), rotates with a continuous motion around a fifth rotation axis (19) parallel to the first rotation axis (12), and supports two feeding pockets (20) suited to house the corresponding groups (4) of tobacco articles and hinged to the first feeding wheel (18) so as to rotate, with respect to the first feeding wheel (18), around corresponding sixth rotation axes (21) parallel to the fifth rotation axis (19).

11. A packer machine (6) according to claim 10, wherein each feeding pocket (20) comprises a bottom wall (30) which is mounted so as to be radially mobile between an extracted position and a retracted position and, in the first feeding station (S1), the bottom wall (30) of each feeding pocket (20) is initially arranged in the retracted position and gradually moves towards the extracted position as the corresponding group (4) of tobacco article goes out of the feeding pocket (20).

12. A packer machine (6) according to claim 10, wherein each feeding pocket (20) comprises two fixed lateral walls (31) and two holding elements (32), which are hinged so as to rotate around corresponding seventh rotation axes (33) parallel to the fifth rotation axis (19) and to move between an operating position, in which the two holding elements (32) keep the corresponding group (4) of tobacco articles inside the feeding pocket (20), and a rest position, in which the two holding elements (32) allow the corresponding group (4) of tobacco articles to enter/go out of the feeding pocket (20).

13. A packer machine (6) according to claim 1 and comprising a second feeding station (S2), which is arranged upstream of the first feeding station (S1) relative to the direction of rotation of the coupling wheel (11), and in which a first insert (5) is fed to the first coupling pocket (17) and, subsequently, a second insert (5) is fed to the second coupling pocket (17).

14. A packer machine (6) according to claim 13, wherein each coupling pocket (17) comprises a bottom wall (26) which is a sucking wall, is mounted so as to be radially mobile on a corresponding housing head (15) and to radially move between an extracted position and a retracted position, and receives and holds the corresponding insert (5) in the second feeding station (S2) by means of suction.

15. A packer machine (6) according to claim 13 and comprising a second feeding wheel (22), which is arranged next to the coupling wheel (11) in correspondence to the second feeding station (S2), rotates with a continuous motion around an eighth rotation axis (23) parallel to the first rotation axis (12), and supports two sucking holding heads (24) suited to hold the corresponding inserts and hinged to the second feeding wheel (22) so as to rotate, with respect to the second feeding wheel (22), around corresponding ninth rotation axes (25) parallel to the eighth rotation axis (23).

16. A packer machine (6) according to claim 1 and comprising a wrapping unit (10), which is arranged next to the coupling wheel (11), receives the two groups (4) of tobacco articles arranged side by side in the releasing station (S3), and wraps a blank around the two groups (4) of tobacco articles so as to form an outer container (2) of the packet (1) of tobacco articles.

17. A wrapping method to manufacture a packet (1) of tobacco articles containing two distinct groups (4) of tobacco articles; the wrapping method comprises the steps of:

moving a first coupling pocket (17) of a coupling wheel (11) which rotates with a continuous motion around a rotation axis (12) into a first feeding station (S1);

feeding, in the first feeding station (S1), a first group (4) of tobacco articles to the first coupling pocket (17);

moving the first coupling pocket (17) out from the first feeding station (S1);

moving a second coupling pocket (17), which is independent of and separate from the first coupling pocket (17), of the coupling wheel (11) into the first feeding station (S1);

subsequently feeding, in the feeding station (S1), a second group (4) of tobacco articles to the second coupling pocket (17);

moving the second coupling pocket (17) out from the first feeding station (S1);

bringing, downstream of the feeding station (S1), the two first and second coupling pockets (17) closer to each other, until the two first and second coupling pockets (17) are side by side; and extracting, in a releasing station (S3), the two groups (4) of tobacco articles together from both the first and second coupling pockets (17) arranged side by side, so that the two groups (4) of tobacco articles are side by side when they come out together of the first and second coupling pockets (17).

18. A wrapping method according to claim 17, wherein:

each first or second coupling pocket (17) comprises two lateral walls (27) so that a downstream side wall (27) of the first coupling pocket (17) faces an upstream side wall (27) of the second coupling pocket (17);

in the first feeding station (S1) the downstream side wall (27) of the first coupling pocket (17) is arranged at a first distance from the upstream side wall (27) of the second coupling pocket (17); and in the releasing station (S3) the downstream side wall (27) of the first coupling pocket (17) is arranged at a second distance smaller that the first distance from the upstream side wall (27) of the second coupling pocket (17) as the two first and second coupling pockets (17) are side by side.

19. A packer machine (6) to manufacture a packet (1) of tobacco articles containing two distinct groups (4) of tobacco articles; the packer machine (6) comprises:

a coupling wheel (11) which rotates with a continuous motion around a first rotation axis (12) and supports a pair of coupling pockets (17), each designed to contain a group (4) of tobacco articles;

a feeding station (S1) in which a first group (4) of tobacco articles is fed to a first coupling pocket (17) and, subsequently, a second group (4) of tobacco articles is fed to a second coupling pocket (17);

an actuating device which brings, downstream of the first feeding station (S1), the two first and second coupling pockets (17) closer to each other, until the two first and second coupling pockets (17) are side by side; and a releasing station (S3), in which the two groups (4) of tobacco articles are extracted together from both the first and second coupling pockets (17) arranged side by side, so that the two groups (4) of tobacco articles are side by side when they come together out of the first and second coupling pockets (17), wherein the coupling wheel (11) comprises a support body (13), which supports the two coupling pockets (17) and is hinged to the coupling wheel (11) so as to rotate relative to the coupling wheel (11) around a second rotation axis (14) which is parallel to the first rotation axis (12).

20. A packer machine (6) to manufacture a packet (1) of tobacco articles containing two distinct groups (4) of tobacco articles; the packer machine (6) comprises:

a coupling wheel (11) which rotates with a continuous motion around a first rotation axis (12) and supports a pair of coupling pockets (17), each designed to contain a group (4) of tobacco articles;

a feeding station (S1) in which a first group (4) of tobacco articles is fed to a first coupling pocket (17) and, subsequently, a second group (4) of tobacco articles is fed to a second coupling pocket (17);

an actuating device which brings, downstream of the first feeding station (S1), the two first and second coupling pockets (17) closer to each other, until the two first and second coupling pockets (17) are side by side; and a releasing station (S3), in which the two groups (4) of tobacco articles are extracted together from both the first and second coupling pockets (17) arranged side by side, so that the two groups (4) of tobacco articles are side by side when they come together out of the first and second coupling pockets (17);

wherein each coupling pocket (17) comprises two lateral walls (27), which are hinged so as to rotate around corresponding second rotation axes (28) parallel to the first rotation axis (12) and to move between an open position, in which the two lateral walls (27) diverge from one another, and a closed position, in which the two lateral walls (27) are parallel to each other.

21. A packer machine (6) to manufacture a packet (1) of tobacco articles containing two distinct groups (4) of tobacco articles; the packer machine (6) comprises:

a coupling wheel (11) which rotates with a continuous motion around a first rotation axis (12) and supports a pair of coupling pockets (17), each designed to contain a group (4) of tobacco articles;

a feeding station (S1) in which a first group (4) of tobacco articles is fed to a first coupling pocket (17) and, subsequently, a second group (4) of tobacco articles is fed to a second coupling pocket (17);

an actuating device which brings, downstream of the first feeding station (S1), the two first and second coupling pockets (17) closer to each other, until the two first and second coupling pockets (17) are side by side;

a releasing station (S3), in which the two groups (4) of tobacco articles are extracted together from both the first and second coupling pockets (17) arranged side by side, so that the two groups (4) of tobacco articles are side by side when they come together out of the first and second coupling pockets (17); and a feeding wheel (18), which is arranged next to the coupling wheel (11) in correspondence to the feeding station (S1), rotates with a continuous motion around a second rotation axis (19) parallel to the first rotation axis (12), and supports two feeding pockets (20) suited to house the corresponding groups (4) of tobacco articles and hinged to the first feeding wheel (18) so as to rotate, with respect to the first feeding wheel (18), around corresponding third rotation axes (21) parallel to the second rotation axis (19).

22. A packer machine (6) to manufacture a packet (1) of tobacco articles containing two distinct groups (4) of tobacco articles; the packer machine (6) comprises:

a coupling wheel (11) which rotates with a continuous motion around a rotation axis (12) and supports a pair of coupling pockets (17), each designed to contain a group (4) of tobacco articles;

a feeding station (S1) in which a first group (4) of tobacco articles is fed to a first coupling pocket (17) and, subsequently, a second group (4) of tobacco articles is fed to a second coupling pocket (17);

an actuating device which brings, downstream of the first feeding station (S1), the two first and second coupling pockets (17) closer to each other, until the two first and second coupling pockets (17) are side by side;

a releasing station (S3), in which the two groups (4) of tobacco articles are extracted together from both the first and second coupling pockets (17) arranged side by side, so that the two groups (4) of tobacco articles are side by side when they come together out of the first and second coupling pockets (17); and a second feeding station (S2), which is arranged upstream of the first feeding station (S1) relative to the direction of rotation of the coupling wheel (11), and in which a first insert (5) is fed to the first coupling pocket (17) and, subsequently, a second insert (5) is fed to the second coupling pocket (17).

23. A packer machine (6) to manufacture a packet (1) of tobacco articles containing two distinct groups (4) of tobacco articles; the packer machine (6) comprises:

a coupling wheel (11) which rotates with a continuous motion around a rotation axis (12) and supports a pair of coupling pockets (17), each designed to contain a group (4) of tobacco articles;

a feeding station (S1) in which a first group (4) of tobacco articles is fed to a first coupling pocket (17) and, subsequently, a second group (4) of tobacco articles is fed to a second coupling pocket (17);

an actuating device which brings, downstream of the first feeding station (S1), the two first and second coupling pockets (17) closer to each other, until the two first and second coupling pockets (17) are side by side;

a releasing station (S3), in which the two groups (4) of tobacco articles are extracted together from both the first and second coupling pockets (17) arranged side by side, so that the two groups (4) of tobacco articles are side by side when they come together out of the first and second coupling pockets (17); and a wrapping unit (10), which is arranged next to the coupling wheel (11), receives the two groups (4) of tobacco articles arranged side by side in the releasing station (S3), and wraps a blank around the two groups (4) of tobacco articles so as to form an outer container (2) of the packet (1) of tobacco articles.

* * * * *